US005161747A

United States Patent [19]

Krämer

[11] Patent Number: 5,161,747

[45] Date of Patent: Nov. 10, 1992

[54] ROLL WINDING MACHINE WITH IMPROVED PRESSING ROLLERS

[75] Inventor: Hans Krämer, Dohr, Fed. Rep. of Germany

[73] Assignee: Kampf GmbH Maschinenfabrik, Wiehl-Mühlen, Fed. Rep. of Germany

[21] Appl. No.: 626,713

[22] Filed: Dec. 13, 1990

[30] Foreign Application Priority Data

Dec. 15, 1989 [DE] Fed. Rep. of Germany ..... 3941384

[51] Int. Cl.[5] ..... B65H 27/00

[52] U.S. Cl. ..... 242/56.9; 242/56.2; 242/65

[58] Field of Search ..... 242/56.9, 56.2, 67.1 R, 242/65

[56] References Cited

U.S. PATENT DOCUMENTS 3,702,687 11/1972 Hall ..... 242/65
3,915,404 10/1975 Kampf et al. ..... 242/56.9
4,842,209 6/1989 Saukkonen ..... 242/67.1 R

FOREIGN PATENT DOCUMENTS 2342515 2/1975 Fed. Rep. of Germany .
1519553 8/1978 United Kingdom .

*Primary Examiner*—Daniel P. Stodola
*Assistant Examiner*—John Q. Nguyen
*Attorney, Agent, or Firm*—Herbert Dubno

[57] ABSTRACT

A roll winding machine with at least one winding shaft on which the winding sleeves are received has a support shaft carrying the pressing rollers and swingable toward the winding shaft on arms. The eccentric rings of the pressing rollers are provided with formations for coupling them together without relative play when the pressing rollers are brought together to form a gapless junction between them.

3 Claims, 2 Drawing Sheets

ROLL WINDING MACHINE WITH IMPROVED PRESSING ROLLERS

FIELD OF THE INVENTION

My present invention relates to a roll winding machine having at least one winding shaft capable of receiving a plurality of winding sleeves or cores upon which a respective roll can be wound and pressing rollers cooperating with the winding sleeves or rolls, having a common support axis and formed with freely rotatable pressing rings along their outer peripheries.

BACKGROUND OF THE INVENTION

A roll winding machine for the winding of strips or bands of a foil, for example a film, longitudinally split from a wider web, is described in German Open Application 23 42 515 and serves to wind up in individual rolls the split strip or foils. The individual pressing rollers are shiftable toward the juxtaposed winding sleeve. The required pressing force is here obtained from helical springs one end of which is engaged in the respective eccentric ring of the pressing roller while the other is fixed in a support ring. The latter engages with a key in a key groove which extends over the total axial length of a tubular shell which is journaled on bearing stubs defining the support axis via slide or roller bearings.

By the rotation of this shell or sleeve it is possible to adjust the prestress of the springs and thus the pressing force applied by the pressing rollers against the rolls. To limit the degree of swing of the eccentric rings, each eccentric ring is provided with an arcuate slit concentric to the inner surface of the eccentric ring and through which an abutment rod passes which is parallel to the support axis. While the support axis is generally fixed in the machine, the winding shafts of the machine can be displaced transversely to their axes on support carriages. The aforedescribed structure and functions of the machine have resulted in a highly expensive and complex machine which often is unreliable and may require substantial maintenance.

Part of the problem with the earlier machines resides in the way the pressing rollers are axially secured. Another source of the problem is the fact that the coiling shafts must be movable.

OBJECTS OF THE INVENTION

It is, therefore, the principal object of the present invention to provide a roll winding machine which is free from the drawbacks of the system described.

Another object of the invention is to provide a roll winding machine having a lesser number of parts and therefore less expensive construction and which enables the pressing rollers to be of a simpler construction and more rapidly mounted and positioned.

Still another object of my invention is to provide an improved roll winding machine with a more reliable and economical construction.

SUMMARY OF THE INVENTION

These objects and others which will become more readily apparent hereinafter are attained, in accordance with the invention by providing the pressing rollers as individual members which are free from the need to be mounted upon a keying sleeve or shell but which can have formations allowing them to interengage in groups and to be mounted upon a simple shaft. The individual members can thus be simply and rapidly arrayed on the shaft and can be independent or coupled together simply by interfitting with one another. The individual members to be grouped together are disposed adjacent one another without gaps therebetween. For this purpose, these cooperating formations can include annular flanges and shoulders which are complementary to one another and interengage.

The same effect can be obtained when on one side of each pressing roller and specifically its eccentric ring, a projection is provided which engages in a recess, depression or bore on the opposite side of the next pressing roller. In this case, the annular flanges and shoulders can be omitted.

The use of bores and projections allows further simplification in that the bores can be throughgoing bores and the projections can be pins fitted into the bores.

A common axially extending connecting bar can pass through all of the eccentric rings if desired but advantageously is keyed thereto and received without play.

The invention allows coupling of the eccentric rings of those members which are grouped together for juxtaposition with a winding sleeve on the winding shaft and can be bridged and held in spaced apart relationship by respective tubes. The tube preferably is roller tube placed over the individual pressing ring and can have bearing flanges at its ends which correspond in axial length to the width of the pressing roller. Because of the relatively long insertion depth of the bearing flange, relative twisting of the individual members can reliably be prevented. In addition, the tube provides a doubled journaling of the individual members so that journaling precision can be ensured and roughness in operation can be avoided.

For axially securing the pressing rollers or groups of pressing rollers in place along the support axis, C-shaped positioning rings can be provided and can have setscrews holding them in place. The configurations of the invention which allow coupling of the individual pressing rollers without play between them makes it possible to mount a support axis on free ends of swingable arms which can move the pressing rollers toward and away from the winding shaft and thereby eliminate the need to move the winding shaft on respective carriages.

More specifically, the roll winding machine can comprise:

a machine housing;

at least one winding shaft journaled in the housing and rotatable to wind up respective rolls of a web strip fed to respective roll sleeves on the winding shaft;

a support shaft defining a support axis spaced from and parallel to the winding shaft;

a plurality of individual pressing rollers disposed along the support axis and juxtaposed with the sleeves to ride upon a respective roll of the web strip formed thereon, each of the rollers comprising:

an inner bearing directly engaging the support shaft, an eccentric ring having an eccentric inner surface directly engaging the inner bearing and rotatable thereon, and an outer peripheral surface, an outer bearing on the outer peripheral surface, and a pressing ring rotating on the outer bearing, the individual pressing rollers being provided with mating formations interfitting upon movement of the pressing rollers together to group pressing rollers for juxtaposition with a roll sleeve; and means for applying the pressing rollers against the rolls.

Alternatively the roll winding machine can comprise:

a machine housing;

at least one winding shaft journaled in the housing and rotatable to wind up respective rolls of a web strip fed to respective roll sleeves on the winding shaft;

a support shaft defining a support axis spaced from and parallel to the winding shaft;

a plurality of individual pressing rollers spaced along the support axis and juxtaposed with the sleeves to ride upon a respective roll of the web strip formed thereon, each of the rollers comprising:

an inner bearing directly engaging the support shaft, an eccentric ring having an eccentric inner surface directly engaging the inner bearing and rotatable thereon, and an outer peripheral surface, an outer bearing on the outer peripheral surface, a pressing ring rotating on the outer bearing, and a tube bridging at least two of the individual rollers grouped together, the tube receiving the pressing rings of the two rollers; and means for applying the pressing rollers against the rolls.

In another embodiment the roll winding machine can comprise:

a machine housing;

at least one winding shaft journaled in the housing and rotatable to wind up respective rolls of a web strip fed to respective roll sleeves on the winding shaft;

a support shaft defining a support axis spaced from and parallel to the winding shaft;

a plurality of individual pressing rollers spaced along the support axis and juxtaposed with the sleeves to ride upon a respective roll of the web strip formed thereon, each of the rollers comprising:

an inner bearing directly engaging the support shaft, an eccentric ring having an eccentric inner surface directly engaging the inner bearing and rotatable thereon, and an outer peripheral surface, an outer bearing on the outer peripheral surface, a pressing ring rotating on the outer bearing, and a connecting bar extending axially through the eccentric rings and keyed thereto; and means for applying the pressing rollers against the rolls.

BRIEF DESCRIPTION OF THE DRAWING

The above and other objects, features and advantages of my invention will become more readily apparent from the following description, reference being made to the accompanying highly diagrammatic drawing in which.

SPECIFIC DESCRIPTION

Figure 1:
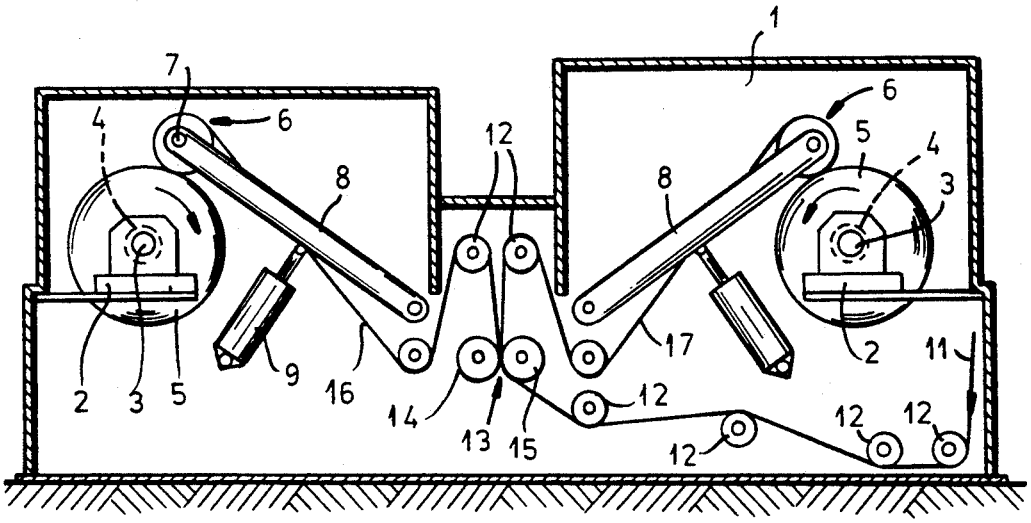
FIG. 1 is a vertical section through a roll winding and web-split machine according to the invention as seen in front elevation.

In FIG. 1 of the drawing, I have shown a machine housing 1 for a roll winding machine which has two winding shafts 3 journaled in the bearing housings 2. In this construction, the winding shafts 3 are not shiftable in carriages as has been customarily the case. On the winding shafts 3, a plurality of winding sleeves 4 can be accommodated one next to the other and rolls 5 of the strip material can be wound thereon.

Each winding sleeve is juxtaposed with a pressing roller 6 or group of pressing rollers 6 disposed on a support shaft 7 extending parallel to the winding shaft 3. The number of pressing rollers 6 on each support shaft 7 corresponds to the number of winding sleeves on the respective winding shaft or can exceed the number of winding sleeves when the pressing rollers are grouped in twos or threes for example.

The pressing rollers 6 can be swung toward the respective winding sleeves 4 and against the rolls 5 by a pair of swingable arms 8 whose free arms carry the support shaft 7 (FIG. 1) and which are connected with a piston-and-cylinder unit 9 which controls the force with which the rollers 6 press against the rolls and can be actuated to swing the pressing rollers 6 away from the rolls 5.

A web 11 to be split and wound up into the rolls 5, is fed along a guide path around various deflection rollers 12 to a cutting device 13 which comprises a blade shaft 14 and a countershaft 15. The blade shaft and countershaft are provided with respective rotary blades which can longitudinally split the foil web into respective strips 16 and 17 corresponding in number to the coiling sleeves 4 and the pressing rollers 6. The individual strips 16 and 17 are then guided between the pressing roller 6 and the respective coil 5 rotating in the direction of the arrows. The cutting device 13 can be driven by a respective drive not shown and the feed rollers 12 can likewise be driven by still another motor. The winding shaft 3 are each driven by a respective motor.

Figure 2:
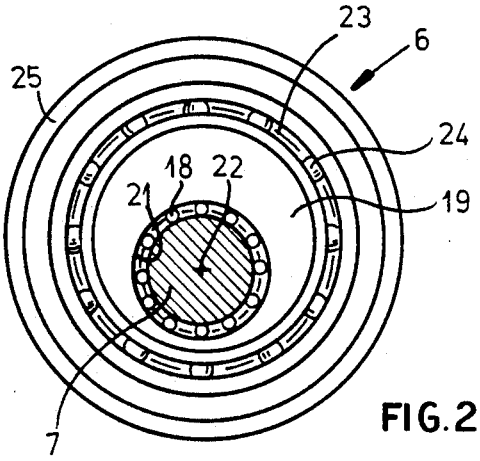
FIG. 2 is an enlarged cross sectional view taken in a plane through the support shaft showing a pressing roller of the invention.

FIG. 2 shows one of the pressing rollers 6 (see also FIG. 8) in an enlarged form and from these figures it will be apparent that each pressing roller 6 comprises an eccentric ring 19 which is directly journaled on the shaft 7 in a respective needle bearing 18. The eccentric inner surface 21 of the eccentric ring 19 lies concentric to the centerline 22 of the support shaft 7.

On the outer surface 23 of the eccentric ring 14, a pressing ring 25 is freely rotatable on a roller bearing 24.

Figure 8:
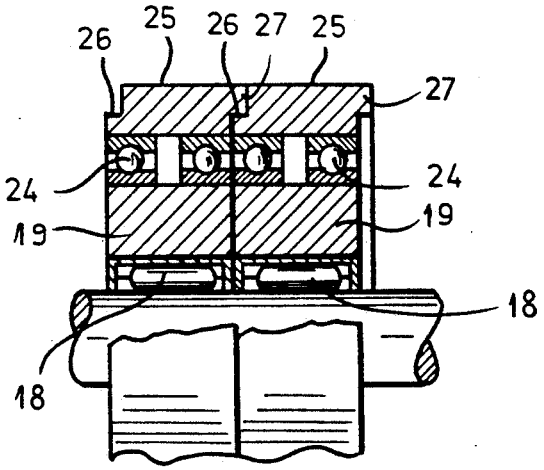
FIG. 8 is a view similar to FIG. 3 but showing grouping of a pair of rollers.

The pressing force between the eccentric ring 19 and the roll 5 engaged by its pressing roller is not especially controlled or regulated. Indeed the pressing rollers 6 can rest by their respective intrinsic weight against the respective roll 5 as it is being wound-up. The tension on the strip which passes around the pressing roller 6 assists in pressing the eccentric ring against the respective roll. The number of pressing rollers 6 can correspond to or exceed the number of roll sleeves and the pressing ring 6 are individual members or elements which can be grouped together (FIG. 8) so that the grouped rollers have no gaps between them and the rollers fit into one another. In a gap free arrangement of the pressing rollers 6 on the support shaft 7, the annular flanges 27 on one side of each pressing ring will fit into the complementary annular shoulder 26 formed in the opposite side of an adjacent pressing ring (FIG. 8).

Instead of a form locking connection utilizing annular flanges 27 and annular shoulders 26, the form locking engagement can use a hole or pin construction. Such an arrangement has been shown at the center in FIG. 3 in which the eccentric ring 19 may have blind holes 28 drilled axially therein. One of the holes forms a receiving depression while the other hole is formed with a pin 29 which can engage in the hole 28 of an adjacent pressing roller.

Figure 4:
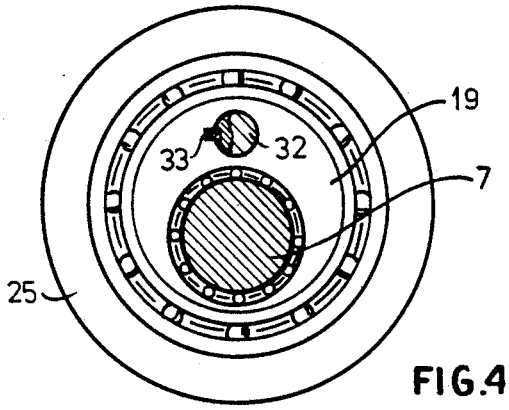
FIG. 4 is a cross sectional view illustrating a modified arrangement of the pressing roller.
Figure 3:
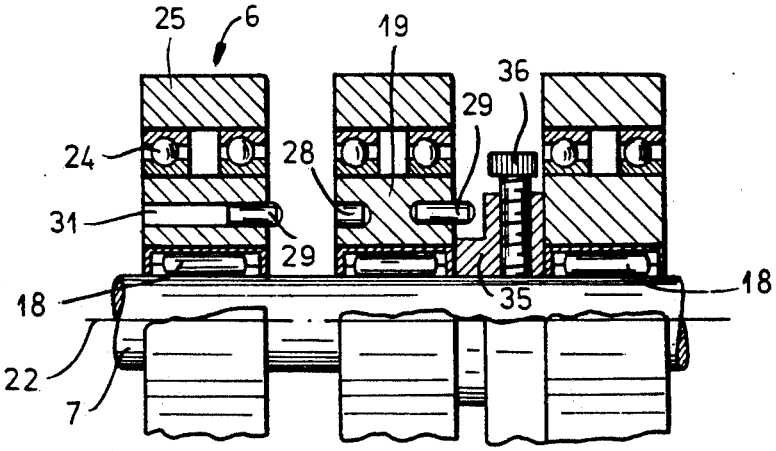
FIG. 3 is a partial elevation and partial sectional view from the side illustrating a plurality of pressing rollers on their support shaft.
Figure 7:
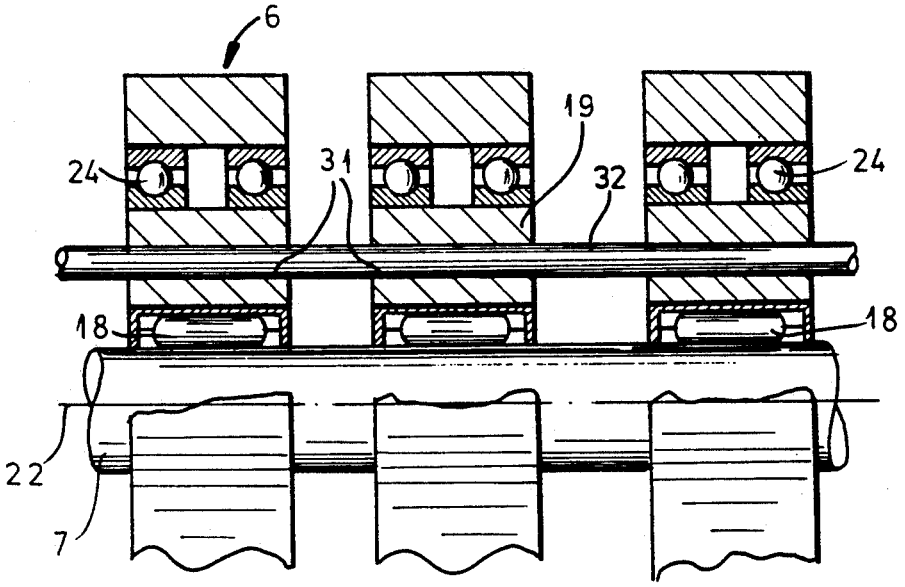
FIG. 7 is a view similar to FIG. 3 but applicable to the roller of FIG. 4.

As indicated for the left-hand pressing roller in FIG. 3, a throughgoing bore 31 can be provided and can receive on one side the pin 29. FIGS. 4 and 7 show another embodiment in which all of the eccentric rings 19 are traversed by a connecting bar 32 secured in the eccentric rings 19 without play by respective keys 33. While in FIGS. 3 and 7 the individual rollers are not grouped for convenience of illustration, it will be apparent that grouping as in FIG. 8 is possible and the eccentric rings of the grouped rollers will be coupled together.

Figure 5:
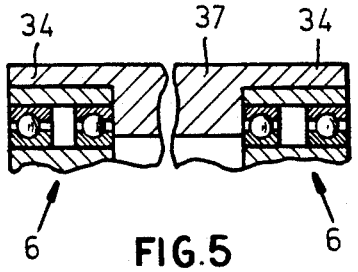
FIG. 5 is an illustration of still another embodiment of the invention for connecting a plurality of individual pressing rollers.
Figure 6:
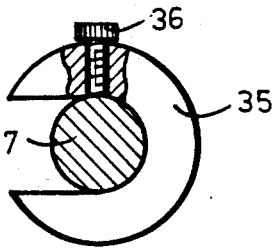
FIG. 6 is a sectional view illustrating the use of a locking element to hold the pressing rollers axially in place.

The mutual spacing between two grouped pressing rollers 6 can be bridged as shown in FIG. 5 by a roller tube 37 which is shoved axially over these pressing rollers. This tube can have bearing flanges 34 at both of its ends to receive the pressing ring of the pressing rollers 6 and can have a length equal to the width of these pressing rings. To axially secure the pressing rollers on the shaft 7 locking rings 35 can be provided as shown in FIG. 6. These locking rings can have a C-shaped cross section and can be held in place by setscrews 36 clamped against the shaft 7. The coils or coiling rolls located at different sides of the machine in the embodiment illustrated need not lie in a horizontal plane but can also be spaced apart in vertical planes relative to one another. This of course requires only a modification of the web path and allows the rolls to be wound-up in the same direction or sense.

I claim:

1. A roll winding machine, comprising:

a machine housing;

at least one winding shaft journaled in said housing and rotatable to wind up respective rolls of a web strip fed to respective roll sleeves on said winding shaft;

a support shaft having a radially outermost surface and defining a support axis spaced from and parallel to said winding shaft;

a plurality of individual pressing rollers spaced along said support axis and slidable along said support shaft outermost surface, said pressing rollers being juxtaposed with said sleeves to ride upon respective rolls of said web strip formed thereon, said rollers being grouped to form gap-free roller units, each of said rollers comprising:

an inner bearing directly engaging said support shaft, an eccentric ring having an inner surface directly engaging said inner bearing and rotatable thereon and an eccentric outer peripheral surface, an outer bearing on said outer peripheral surface, a pressing ring rotating on said outer bearing, and a connecting bar spaced from said support shaft outermost surface and extending axially through said eccentric rings and keyed thereto; and means for applying said pressing rollers against said rolls.

2. The roll winding machine defined in claim 1, further comprising a C-shaped clamp fitted over said support shaft and axially abutting at least one of said individual rollers for axially securing same, said clamp being provided with a setscrew securing it to said support shaft.

3. The roll winding machine defined in claim 1 wherein said means for applying said pressing rollers against said rolls includes a plurality of arms swingable on said housing and having free ends carrying said support shaft.

* * * * *